US005314357A

United States Patent [19]

Weidler

[11] Patent Number: 5,314,357

[45] Date of Patent: May 24, 1994

[54] COMBINED ELECTRICAL CONNECTOR

[75] Inventor: Charles H. Weidler, Lancaster, Pa.

[73] Assignee: The Whitaker Corporation, Wilmington, Del.

[21] Appl. No.: 29,085

[22] Filed: Mar. 10, 1993

[51] Int. Cl.[5] ..... H01R 13/514

[52] U.S. Cl. ..... 439/701; 439/731; 439/680

[58] Field of Search ..... 439/638, 639, 701, 731, 439/540, 532, 247, 248, 677, 680, 690; 361/395, 399, 413

[56] References Cited

U.S. PATENT DOCUMENTS 4,343,528 8/1982 Lucius et al. ..... 439/701
4,915,641 4/1990 Miskin et al. ..... 439/701
4,998,887 3/1991 Kaufman et al. ..... 439/701
5,161,997 11/1992 Defibaugh et al. ..... 439/532
5,168,428 12/1992 Suzuki ..... 361/395
5,184,961 2/1993 Ramirez et al. ..... 439/540
5,195,909 3/1993 Huss, Jr. et al. ..... 439/465

*Primary Examiner*—Gary F. Paumen
*Assistant Examiner*—Hien D. Vu

[57] ABSTRACT

An electrical connector (1) comprises, first and second clasping bodies (2) that interlock with each other and define therebetween multiple housing cavities (3), multiple cable connectors (4) in the cavities (3), each connector (4) having a housing (5) with an external profile encircled by one of the cavities (3), front mating faces (7) of the connectors (4) being aligned side to side, relatively wide sections (10) of the connectors (4) overlapping one another laterally, side to side, to achieve a compact width.

9 Claims, 5 Drawing Sheets

COMBINED ELECTRICAL CONNECTOR

FIELD OF THE INVENTION

The present invention relates to an electrical connector for cables, and, more particularly, to such an electrical connector that converts multiple electrical connectors into a single electrical connector.

BACKGROUND OF THE INVENTION

According to USA, an electrical connector for cables comprises, insulated electrical conductors terminated with an electrical connector. Multiple rows of electrical contacts in an insulative housing of the connector are arranged in rows, and are connected with individual, insulated conductors. The insulated conductors can be unshielded or shielded by a conductive jacket. Before the invention, electrical connectors have been available in various sizes and shapes for conformance with technical standards governing dimensional configurations and electrical characteristics. The existing connectors often are inadequate to meet renewed demands for faster and more compact electronic devices. Yet to specify new technical standards would require the design of new connectors that are not in existence. In view of the rapid obsolescence of electronic devices, the design of a new connector can not be accomplished in a timely manner.

As an alternative to design of a new connector, a composite connector can be formed from a number of known connectors. The configurations and electrical characteristics are known for each of the connectors. Each of the connectors would be unchanged when accompanying one another in such a composite connector.

SUMMARY OF THE INVENTION

The invention pertains to an electrical connector comprising a composite of known connectors in a single connector housing that simplifies mounting of the known connectors, and that simplifies connection and disconnect of the known connectors together as a group with another, mating electrical connector. According to a feature of the invention, multiple cable connectors are encircled by first and second clasping bodies that interlock with each other. Each of the connectors has a separate mating face. The clasping bodies clasp the connectors and hold some of them with their front mating faces aligned laterally side to side, and with relatively wide portions of the connectors overlapping one another front to rear to achieve a compact width.

An embodiment of the invention will now be described by way of example with reference to the drawings, according to which:

DETAILED DESCRIPTION

Figure 1:
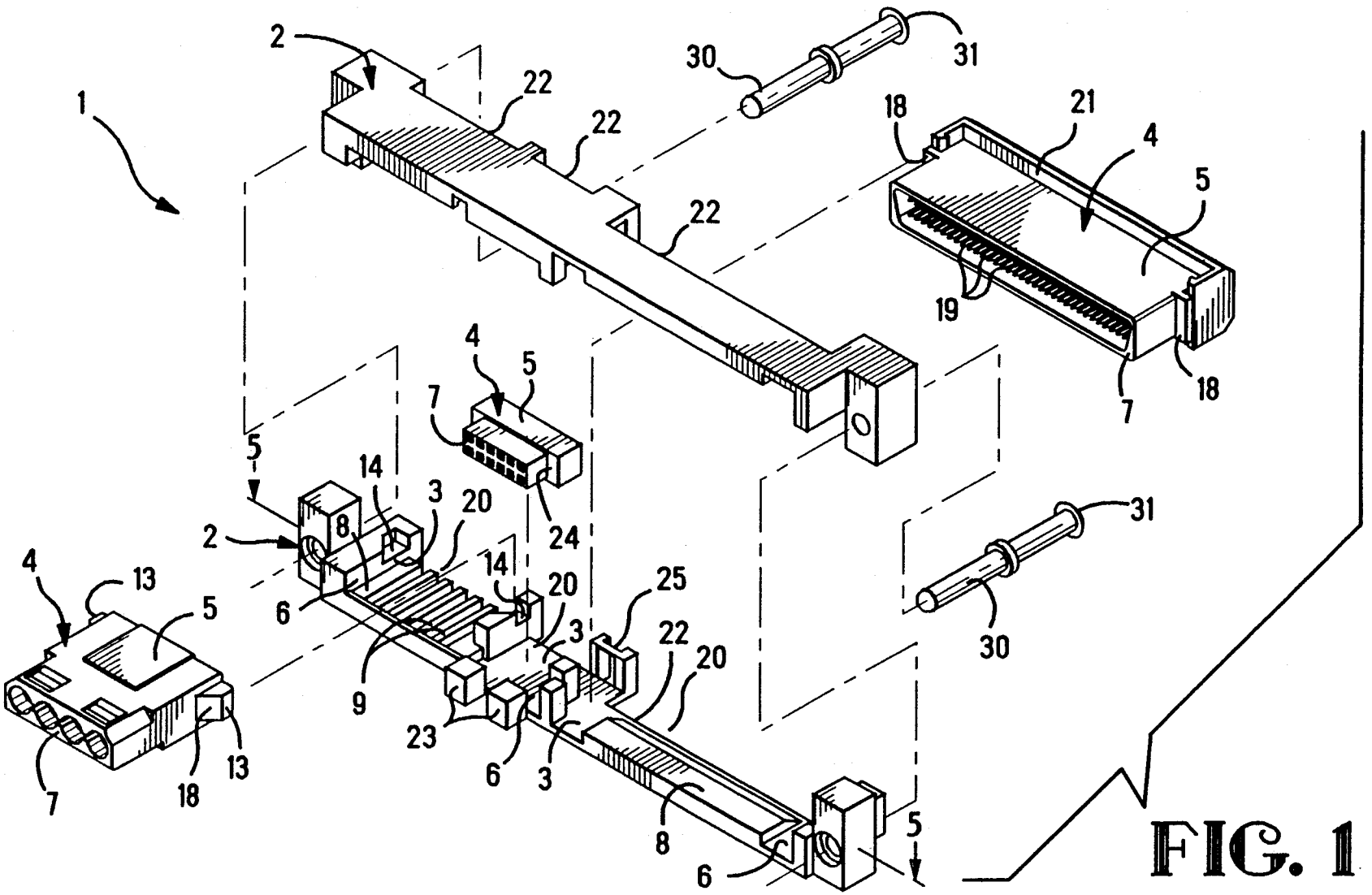
FIG. 1 is a perspective view of an electrical connector with parts separated from one another.

With reference to FIG. 1, an electrical connector 1 comprises, first and second clasping bodies 2 that are each of molded, unitary construction, fabricated from an engineering polymer material. The clasping bodies 2 oppose each other, and define therebetween multiple housing cavities 3.

Individual cable connectors 4, adapted to be mounted in the cavities 3 comprise, a smaller one of the connectors 4 between two, larger ones of the connectors 4. Each of the larger connectors 4 is both, longer, front to rear, and wider laterally, side to side, than the smaller one of the connectors 4. Each connector 4 is constructed with an insulative housing 5 with an external profile. Each of the cavities 3 conforms to and encircles the corresponding external profile of one of the housings 5 of the connectors 4.

The housing receiving cavities 3 have open front ends 6 through which protrude front mating faces 7 of the connectors 4. The individual connectors 7 have front mating faces 7 with different profile shapes. The front mating faces 7 are staggered front to rear. Raised ledges 8 at the open front ends 6 support the larger connectors 4. A thicker one of the ledges 8 is divided into a series of ribs 9 to reduce material.

Figure 3:
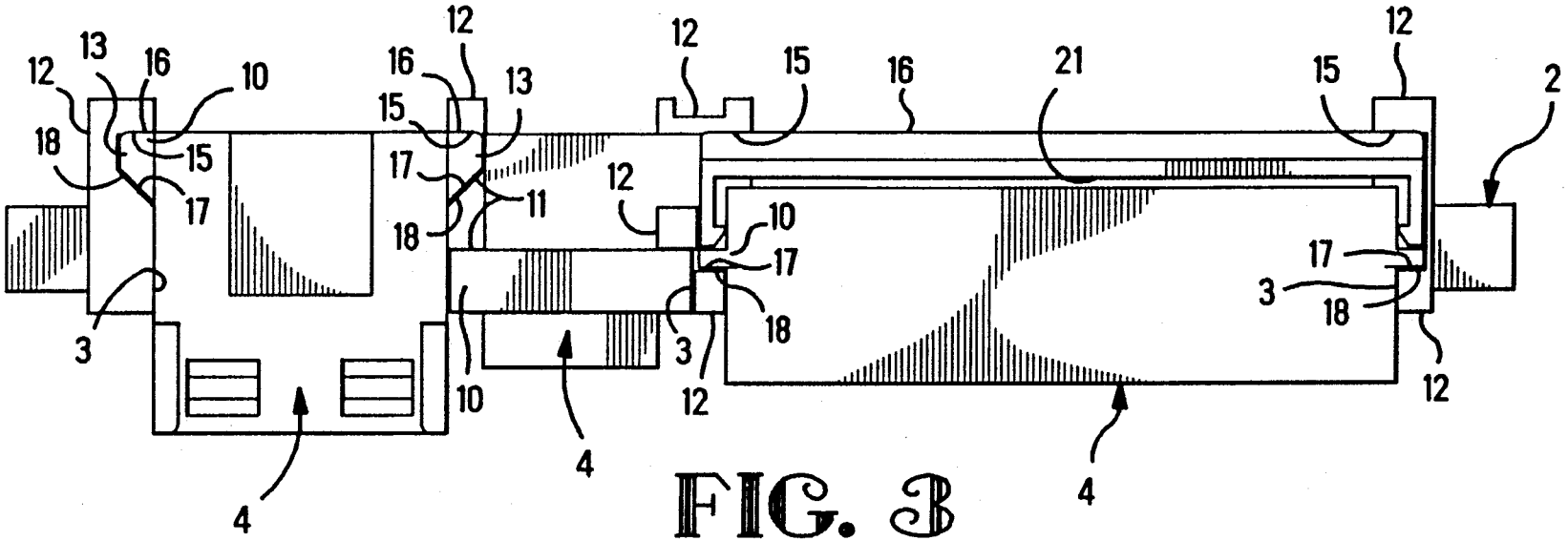
FIG. 3 is a top plan view of separate electrical connectors on one of the clasping members of the connector shown in FIG. 1.
Figure 4:
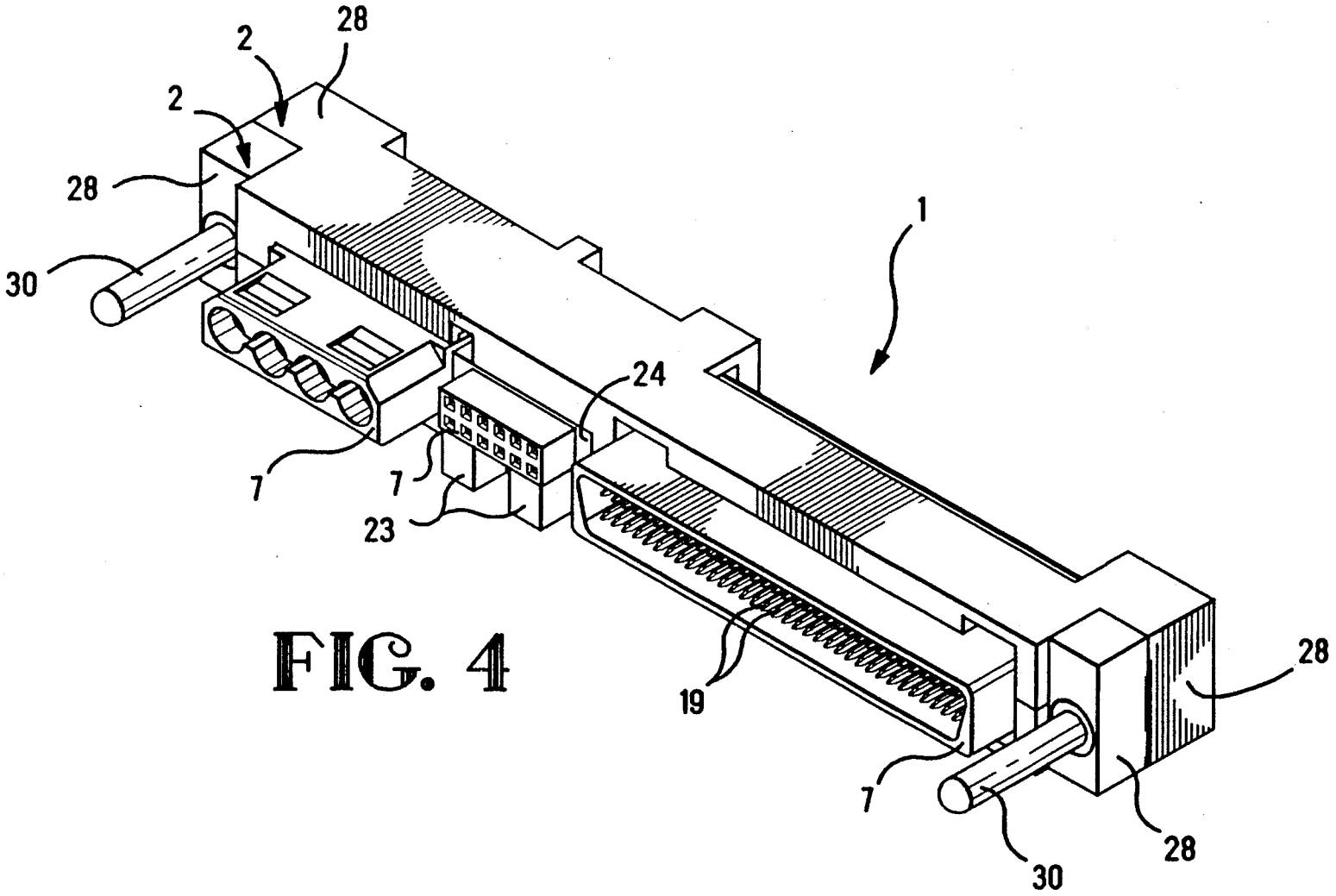
FIG. 4 is a perspective view of the connector shown in FIG. 1 with the parts assembled together.

With reference to FIG. 3, the connectors 4 are shown as being mounted in the housing receiving cavities 3 of one of the clasping bodies 2. Relatively wide sections 10 of at least two of the connectors 4 overlap one another laterally, side to side, as shown at 11 to achieve a compact width for the connector 1. The relatively wide sections are in tandem and are spaced apart front to rear. Pillars 12 on each clasping body 2 project toward the other clasping body 2. The pillars 12 on one clasping body 2 stack on the pillars 12 of the other clasping body 2. The pillars 12 extend between and separate the spaced apart, relatively wide portions 10 of the connectors 4. One of the larger connectors 4 has lateral, protruding, wedge shaped panel locks 13, and the pillars 12 of the clasping bodies 2 have internal, wedge shaped recesses 14 conformingly surrounding the panel locks 13. Front facing surfaces 15, FIG. 5, on the pillars 12 overlap rear facing surfaces 16, FIG. 3, on the connectors 4 to resist relative movement of the connectors 4 and the clasping bodies 2. Rear facing surfaces 17 on the pillars 12 overlap front facing surfaces 18 on the connectors 4 to resist relative movement of the connectors 4 and the clasping bodies 2.

With reference to FIG. 1, multiple electrical contacts 19 in each housing 5, shown in one of the connectors 4, are adapted for connection to insulated conductors of electrical cables, not shown. The housing receiving cavities 3 defined by the clasping bodies 2 have open rear ends 20 to admit such conductors. One of the larger connectors 4 has a strain relief cable clamp 21 adapted to clamp against conductors extending from the connector 4 in a direction transverse to a direction front to rear. In this manner the connector 4 is said to comprise a right angle connector 4, meaning that the connector 4 extends at a right angle to the axes of the conductors. Each of the housing receiving cavities 3 is intersected by a transverse cable exit recess 22, FIGS. 1 and 2, that permit insulated conductors to exit each of the cavities 3 of the connector 1 transversely of the front to rear direction.

The smaller one of the connectors 4 is shorter than the larger connectors 4. At least one of the clasping bodies 2 is constructed with a bipartite post 23 that supports the shorter one of the connectors 4. Rear facing surfaces on the post 23 overlap a front facing surface 24 encircling the smaller one of the connectors 4 to prevent movement of such connector 4 relative to the clasping members 2. The post 23 supports the mating face 7 of the shorter one of the connectors 4 in alignment laterally, side to side, with the mating faces 7 of the longer connectors 7. The shorter one of the connectors 4 has a shroud free mating face 7.

Figure 2:
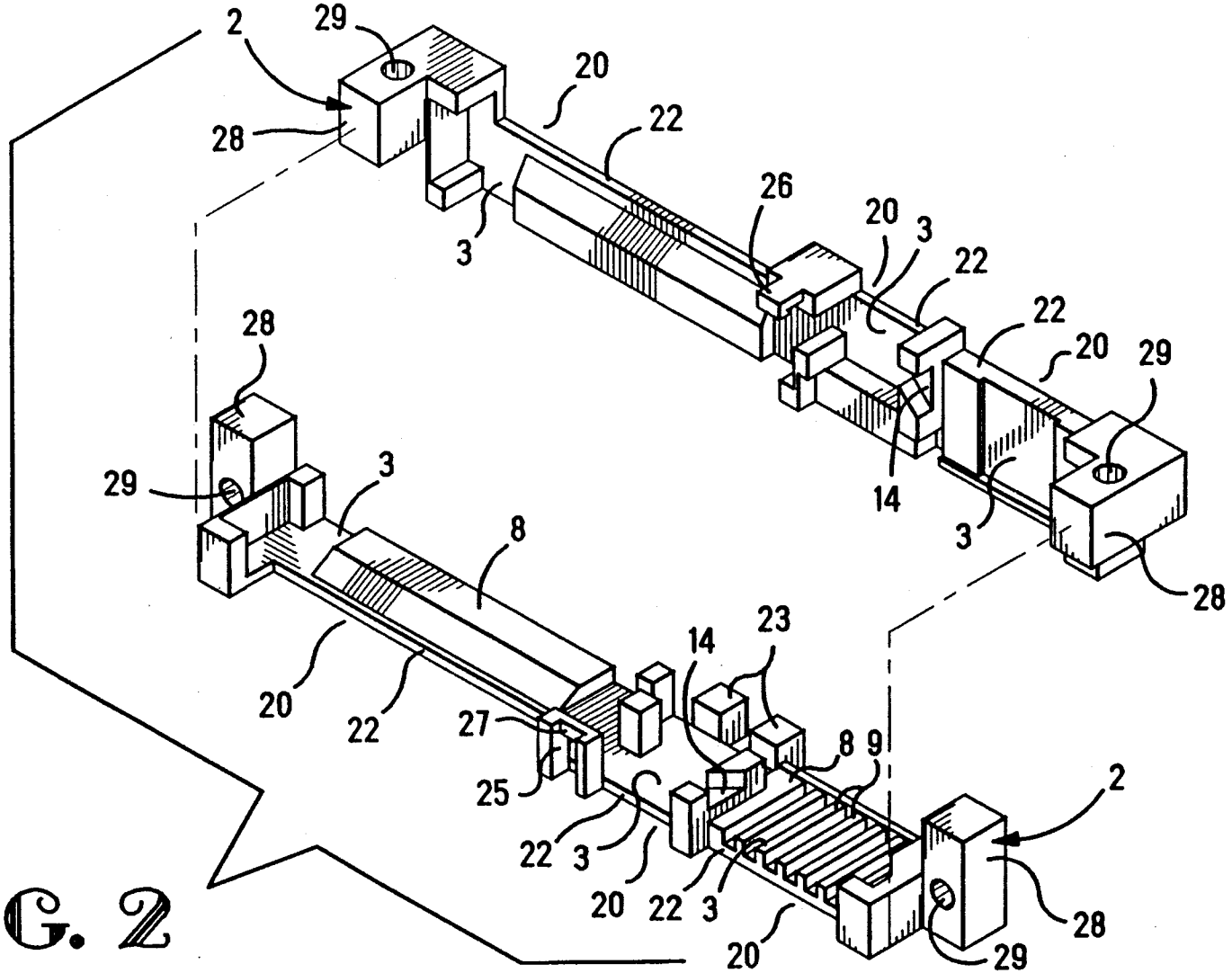
FIG. 2 is a perspective view of clasping members of the connector shown in FIG. 1.
Figure 5:
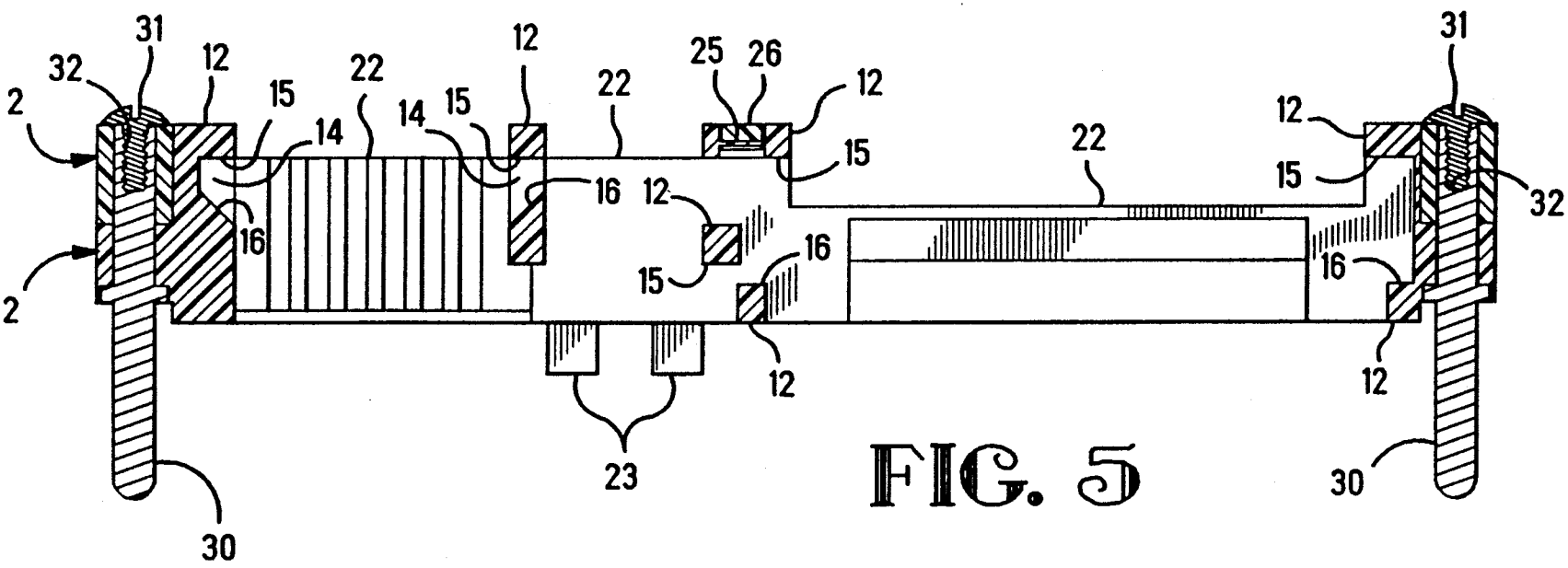
FIG. 5 is a section view taken along the line 5—5 of FIG. 1.

With reference to FIGS. 2 and 5, an open end channel 25 is on a pillar 12 of one of the clasping bodies 2. An elongated hook 26 is on the other one of the clasping bodies 2 projecting toward the open end of the channel 25. The hook 26 is adapted to hook into an undercut 27 in the floor of the channel 25, and thus, interlock the clasping bodies 3 together. The channel 25 and hook 26 comprise interlocked locking members on the clasping bodies 2, the locking members being in tandem front to rear with a relatively shorter one of the connectors 4.

Block form ends 28 of the clasping bodies 2 overlap one another, front to rear. Apertures 29 in the ends 28 of the clasping bodies 2 are aligned, front to rear. Guide pins 30 extend through the apertures 29 and the aligned ends 28 of the clasping members 2. The guide pins 30 project forwardly of the mating faces 7, and are used as alignment guides to align the connector 1 for mating connection with another, mating electrical connector, not shown. A cap screw 31 with an enlarged head is secured in an internally threaded end 32 of each of the pins 30. The pins 30 are restrained from movement by the enlarged heads of the cap screws 31 and by stepped diameters of the pins 30 in stepped diameters of the apertures 29. The connector 1 simplifies mounting of the individual connectors 4 and the connection of all the individual connectors 4 as a group to another mating electrical connector, not shown.

I claim:

1. An electrical connector comprising: first and second clasping bodies that interlock with each other and define therebetween multiple housing cavities, multiple cable connectors in the cavities, each connector having a housing with an external profile, the cavities conforming to and encircling the external profiles of the housings, front mating faces of the connectors being staggered front to rear, relatively wide portions of at least two of the connectors being spaced apart front to rear, and the relatively wide portions overlapping one another laterally, side to side, to achieve a compact width.

2. An electrical connector as recited in claim 1, comprising: the front mating faces of the connectors having different profile shapes.

3. An electrical connector as recited in claim 1, comprising: one of the connectors having protruding wedge shaped panel locks, and the clasping bodies having internal, wedge shaped recesses conformingly surrounding the panel locks.

4. An electrical connector as recited in claim 1, comprising: interlocked locking members on the clasping bodies, and the locking members being in tandem front to rear with a relatively shorter one of the connectors.

5. An electrical connector as recited in claim 1, comprising: pillars on the clasping bodies separating said spaced apart, relatively wide portions of the connectors.

6. An electrical connector as recited in claim 1, comprising: guide pins extending through aligned ends of the clasping bodies, the guide pins projecting forwardly of the mating faces.

7. An electrical connector as recited in claim 1, comprising: a bumper on at least one of the clasping bodies projecting forwardly and supporting a shorter one of the connectors.

8. An electrical connector as recited in claim 1, comprising: one of the connectors having a shroud free mating face, and at least one of the clasping bodies having a post projecting forwardly of the shroud free mating face.

9. An electrical connector as recited in claim 1, comprising: A post on at least one of the clasping bodies projecting forwardly of a shorter one of the connectors, the post being aligned at a front end with the mating faces of the longer ones of the connectors.

* * * * *